US007874188B2

(12) United States Patent
Chudzicki

(10) Patent No.: US 7,874,188 B2
(45) Date of Patent: Jan. 25, 2011

(54) ANTI-THEFT LATCH SHIELD

(76) Inventor: Jim Chudzicki, 10 Emerald Glen, Laguna Niguel, CA (US) 92677

( * ) Notice: Subject to any disclaimer, the term of this patent is extended or adjusted under 35 U.S.C. 154(b) by 0 days.

(21) Appl. No.: 12/583,354

(22) Filed: Aug. 20, 2009

(65) Prior Publication Data

US 2010/0122559 A1 May 20, 2010

Related U.S. Application Data

(60) Provisional application No. 61/199,371, filed on Nov. 17, 2008.

(51) Int. Cl.
*E05B 67/38* (2006.01)

(52) U.S. Cl. ..... 70/56; 70/54; 70/203; 70/212; 70/417; 292/DIG. 32

(58) Field of Classification Search ..... 70/54–56, 70/417, 202, 203, 211, 212; 292/DIG. 32
See application file for complete search history.

(56) References Cited

U.S. PATENT DOCUMENTS 4,895,007 A * 1/1990 Eberly ..... 70/54
5,118,149 A * 6/1992 Emmons ..... 292/327
5,737,946 A * 4/1998 Sole et al. ..... 70/54
5,743,118 A * 4/1998 Anderson ..... 70/56

* cited by examiner

*Primary Examiner*—Suzanne D Barrett
(74) *Attorney, Agent, or Firm*—Edward E. Roberts

(57) ABSTRACT

An anti-theft shield that protects the latching apparatus on the large rear doors of cargo trucks and truck trailers is provided, the shield including an elongated sheath-like member for sliding over and enclosing the cargo door latch handle, and a connected panel member for extending over and protecting the cargo door latch mechanism and the associated padlock for locking the latch handle to the latch mechanism. At a first end of the sheath-like member on the rear side thereof is a planar guide member for insertion behind the latch handle and pivot pin locking hook. The shield is secured in position over the latch mechanism by means of the guide member in combination with a shield locking bracket having an opening for accepting the padlock bight during the locking procedure.

10 Claims, 6 Drawing Sheets

17
26
11
10
12a
22
21
23
20
14
12
23a
19a
15
16
12b
23b
23c
25
25a
19

11
17
26
10
12
27
12c
20
12b
25

35a
32
33
35
38a
34
30
12d
12
17
15
26
19
14

35a
40a
40
32a
30
33a
35
34a

ANTI-THEFT LATCH SHIELD

CLAIM FOR BENEFIT OF EARLIER FILING DATE

This application claims the benefit of U.S. Provisional Application No. 61/199,371 filed on 17 Nov. 2008 and entitled "Anti-Theft Latch Cover". This utility application has the same inventor and subject matter as the said Provisional Application.

BACKGROUND

The background of the invention will be discussed in two parts.

FIELD OF THE INVENTION

The present invention relates in general to security shields for door latches and more particularly to anti-theft shielding that protects the latch mechanism and associated padlock on the large rear doors of cargo trucks and truck trailers.

PRIOR ART

Apparatus for securing the rear doors of cargo trucks and trailers has become increasingly necessary in order to protect the contents therein from theft. Such apparatus typically consists of a latch mechanism, a padlock for the latch mechanism, and a protective cover for the latch/lock combination. The latch mechanism typically includes a pivot point attached to the cargo door with a hook pivotal about the pivot point for securely engaging the truck body, an elongated latch handle attached at a first end to the hook for pivoting it about the pivot point, and a keeper attached to the cargo door for receiving and securing the other end of the latch handle. The padlock locks the other end of the latch handle to the keeper. Since tools such as bolt cutters are available that can cut through the latch handle of the latch mechanism as well as the padlock, the latch handle/padlock combination is usually the weak link in the apparatus, and thus the protective cover has assumed increased importance. Various anti-theft mechanisms are in use for securing the rear doors of cargo trucks, as well as other similar doors, however, a search of the prior art has not disclosed the protective shield of the present invention. Devices of interest are shown and described in U.S. Pat. No. 5,737,946 issued to Sole et al on 14 Apr. 1998, U.S. Pat. No. 6,010,166 issued to Hamilton, et al on 19 Jan. 2000, and U.S. Pat. No. 6,357,266 issued to Buren on 19 Mar. 2002.

SUMMARY

An anti-theft shield is provided for the typical cargo door latch mechanism and associated padlock of a cargo truck. The shield includes an elongated sheath member for sliding over and substantially enclosing the latch handle of the latch mechanism, and a connected panel member for extending over and protecting the interlocking sheath, latch handle, keeper, and padlock. In mounting the anti-theft shield of the invention to the latch mechanism the sheath member is slid over and down the open latch handle to position a sheath guide member behind the latch handle and angular hook associated with the pivot end of the latch handle. The shielded latch handle is then swung down about the latch pivot pin to engage the hook in locking position with the truck body, and to bring the latch handle into a locking position with the keeper assembly of the latching mechanism. The latch handle, panel member and keeper have openings that are brought into alignment when the latch handle is brought into the locking position with the keeper. The bight of the padlock is then inserted through these aligned openings and the padlock locked to provide a protective shield for the latch mechanism and padlock. There is thus provided an improved anti-theft device that is simply, easily and quickly installed over the typical cargo truck locking mechanism. The foregoing and other objects, features and advantages will become apparent from a reading of the specification when taken in conjunction with the drawings in which like reference numerals refer to like elements in the several views.

DRAWINGS

DESCRIPTION

Figure 1:
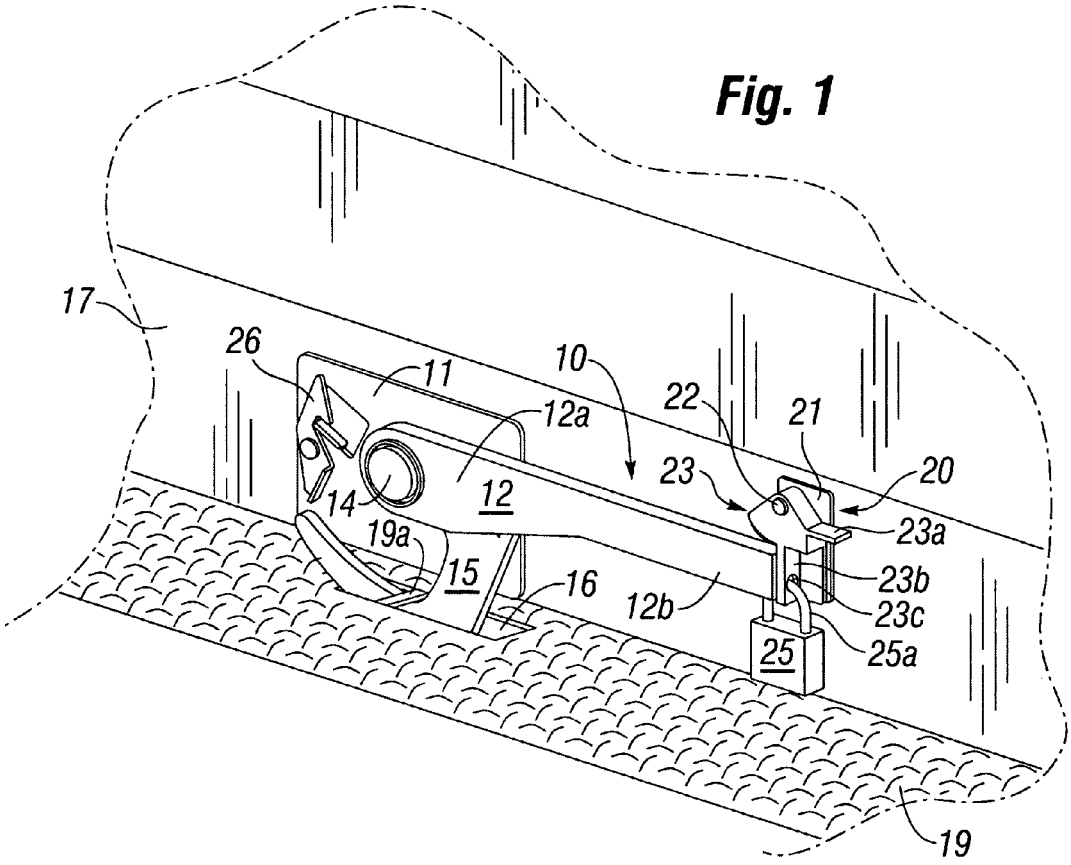
FIG. 1 is a perspective view of a typical locking mechanism used for securing the rear doors of cargo trucks and trailers.

FIG. 1 illustrates a typical locking mechanism, generally designated 10, such as is used for securing a roll-up cargo door of a cargo truck or trailer. As shown, the mechanism 10 is in the fully locked arrangement and includes a mounting plate 11 affixed to the cargo door 17 that has a secured pivot pin 14 about which latch handle 12 is pivoted, handle 12 having a pivot end 12*a* and a distal end 12*b*. Fixedly extending from handle 12 is an angular hook 15, which when handle 12 is fully pivoted in a clockwise direction about pivot pin 14, will extend as shown through opening 16 in truck floor 19 and under catcher plate 19*a* to securely engage the underside of floor 19. Plate 11 further includes latch handle stop 26 that provides means for receiving and securing handle 12 in the open upright position.

Figure 4:
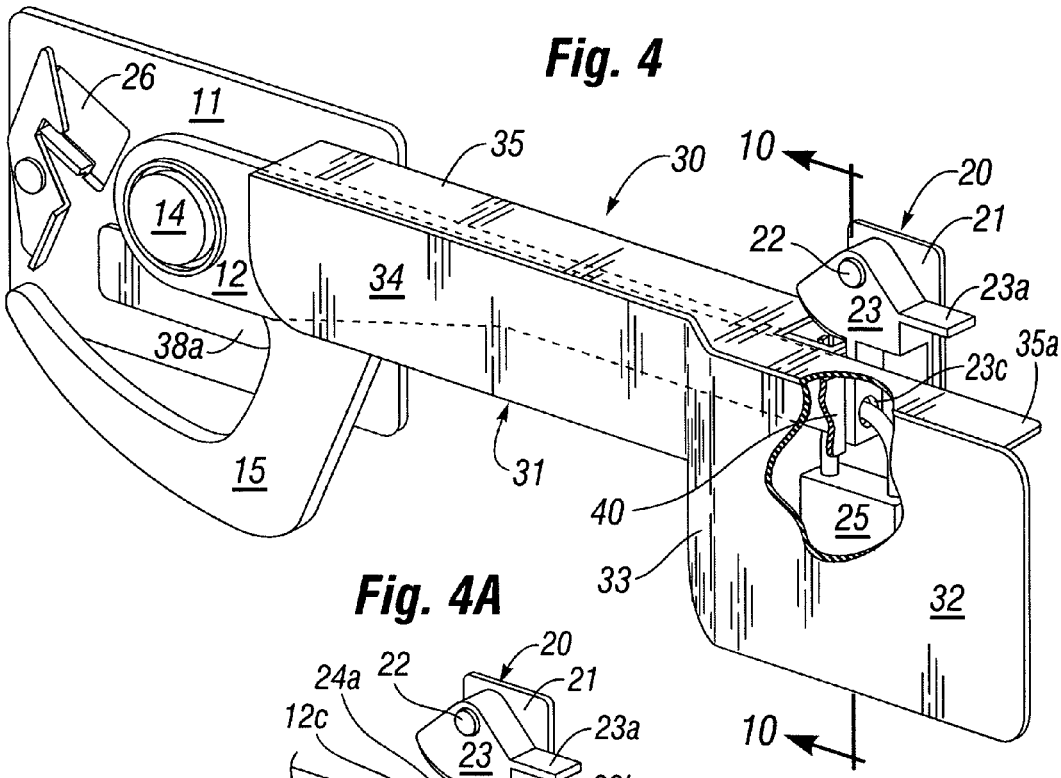
FIG. 4 is a front perspective view of the anti-theft latch shield of the invention as used with the locking mechanism of FIG. 1, and includes a fragmentary view of a portion of the keeper assembly.
Figure 4A:
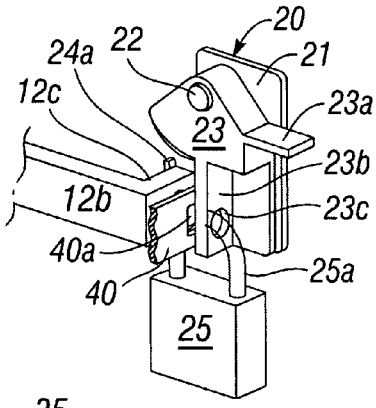
FIG. 4A is an enlarged view of the fragmentary view of FIG. 4.

Also shown in FIG. 1, and further in FIGS. 4 and 4A, is a keeper assembly, generally designated 20, that co-acts with the distal end 12*b* of latch handle 12 to lock hook 15 into place. Keeper assembly 20 includes a mounting plate 21 affixed to the cargo door 17 that has a pivot pin 22 secured to mounting plate 21, and a padlock locking flange, generally designated 23, pivotally mounted to pivot pin 22. Locking flange 23 includes a manual lifter tab 23*a* and a tab 23*b* that has an opening 23*c* for receiving the bight 25*a* of padlock 25. The co-action between the distal end of latch handle 12 and locking flange 23 is more fully explained infra.

Figure 2:
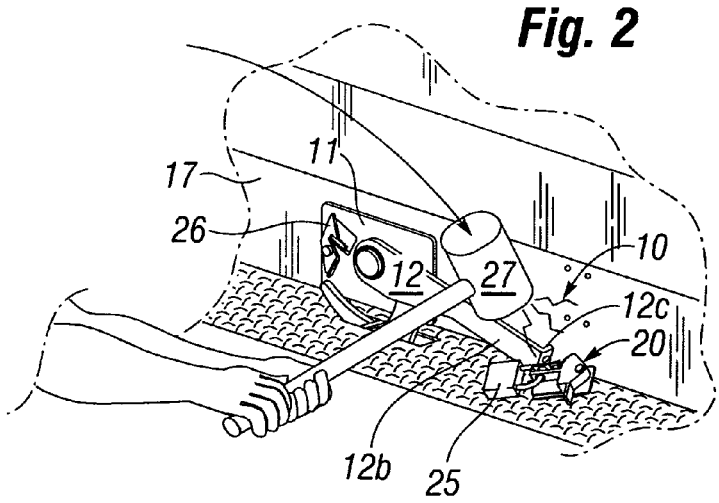
FIG. 2 is illustrative of the use of a tool for easily breaking the locking mechanism of FIG. 1.

FIG. 2 illustrates the use of a tool such as a mallet 27 for easily breaking the typical locking mechanism 10 of FIG. 1. As indicated, the keeper assembly 20 is a weak link which when impacted with enough force will be damaged sufficiently to allow latch handle 12 to be rotated counterclockwise to open cargo door 17. Other tools such as bolt cutters work equally well to allow a thief to quickly breach the typical locking mechanism.

Figure 3A:
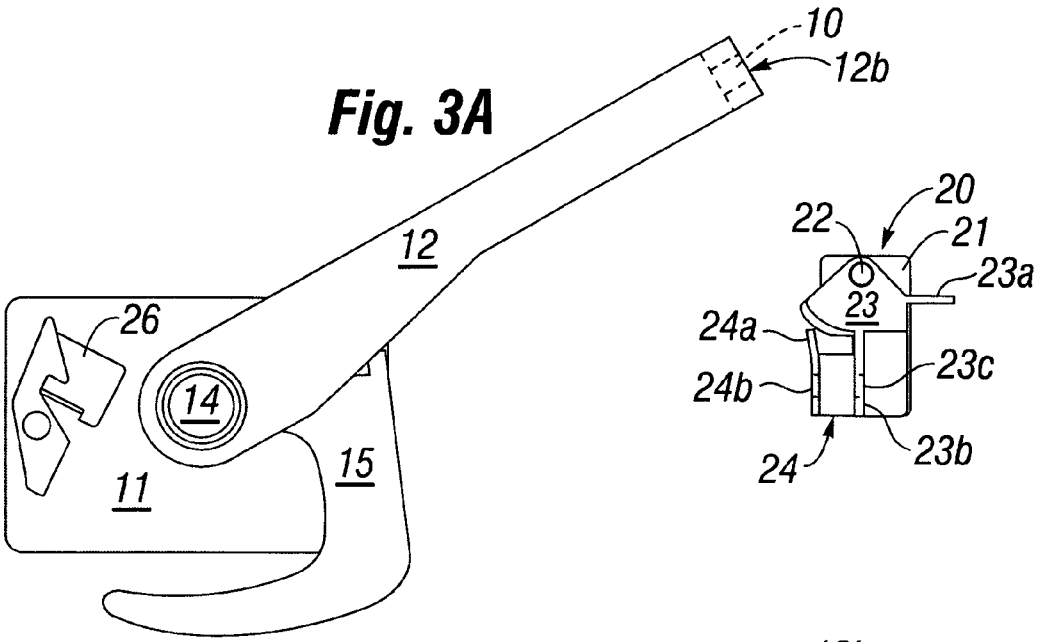
FIG. 3A illustrates the latch handle in the open position with the locking hook of the locking mechanism not yet in the final locking position
Figure 3B:
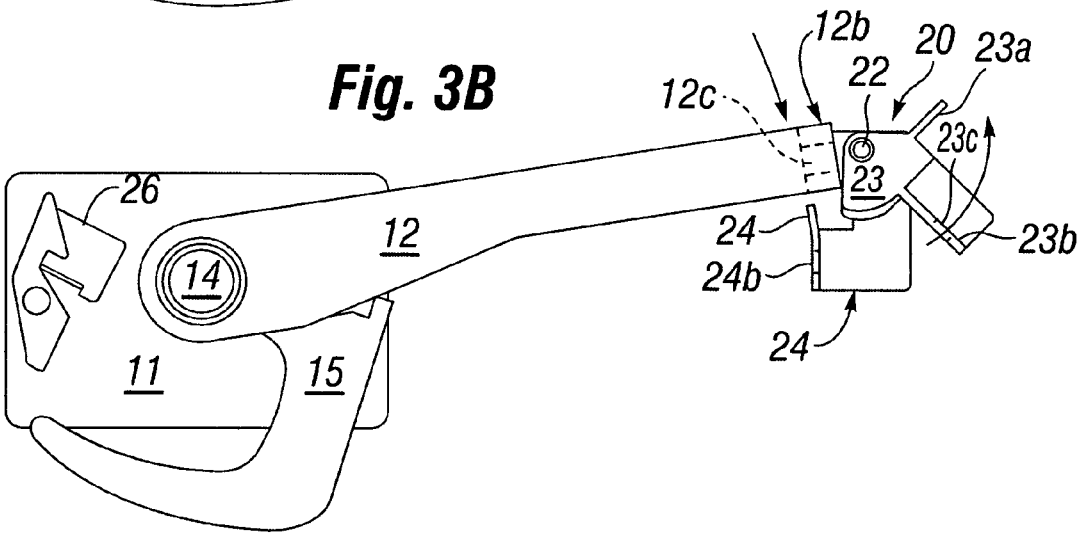
FIG. 3B illustrates clockwise rotation of the latch handle into initial contact with the keeper of the locking mechanism.
Figure 3C:
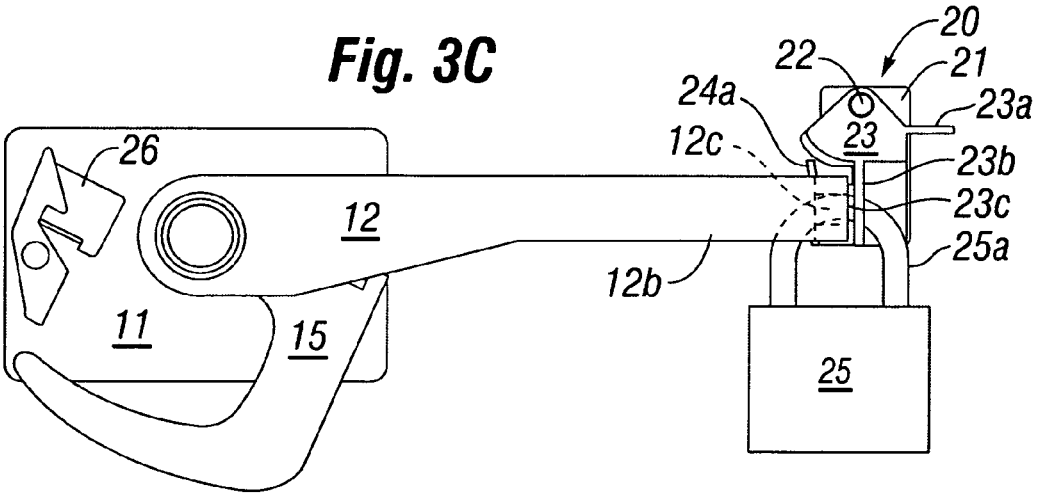
FIG. 3C illustrates the latch handle in closed position in the keeper with the locking hook of the locking mechanism in the final locking position.

FIGS. 3A-3C illustrate the manner in which keeper assembly 20 co-acts with handle 12 to lock hook 15 into floor 19. FIG. 3A shows handle 12 in the open position, that is, not in contact with keeper 20, and hook 15 not in final locking arrangement with truck floor 19. Pivotable locking flange 23 is in a gravity dictated mode with tab 23*b* in a vertical orientation.

FIG. 3B shows handle 12 being pivoted clockwise around pivot pin 14 to make initial contact with keeper 20. Hook 15 is now almost in final locking arrangement with floor 19. When the distal end 12*b* of handle 12 contacts locking flange 23, locking flange 23 will be forced to pivot counterclockwise around pivot pin 22 to allow passage of end 12*b* to settle in latch handle stop 24*a* of keeper 20, that is, into the final locking position. After passage of distal end 12*b*, the locking flange 23, through the force of gravity, will pivot clockwise to settle back to its original position.

FIG. 3C shows handle 12 in the closed position, that is, fully pivoted with distal end 12*b* set into keeper assembly 20 with hook 15 in final locking arrangement with truck floor 19. As shown, distal end 12*b* is seated in keeper 20, tab 23*b* returned to its original position generally due to the force of gravity, and the bight 25*a* of lock 25 inserted through lined up apertures 23*c*, 24*b* (FIG. 3B) and 12*c* of distal end 12*b* of handle 12. Thus, to lock down the arrangement bight 25*a* of padlock 25 is inserted through these apertures after which padlock 25 is locked in the normal manner.

FIG. 4 is a perspective view illustrating a first embodiment of the anti-theft latch shield of the invention, generally designated 30, with shield 30 in final attachment to the locking mechanism 10 to provide anti-theft protection. As configured, shield 30 includes an elongated sheath-like portion generally designated 31 for protecting the handle 12 and a pocket-like portion forwardly extending from the sheath-like portion 31 for protecting the interlocking distal end of latch handle 12, keeper 23 and padlock 25. Sheath portion 31 is partially defined by front plate 34 and top plate 35. The pocket-like portion is partially defined by front plate 32, top plate portion 35*a*, and by plate 33 which in sloping manner connects plates 32 and 34. Also shown, and as will be further discussed, is guide 38*a* which extends from rear plate 38 and is positioned behind handle 12 and below pivot 14 maintain the shield 30 in the required position.

As indicated in the fragmentary view of FIG. 4, and more clearly in the enlarged fragmentary view of FIG. 4A, the distal end 12*b* of handle 12 includes a right angled backwardly extending portion 12*c* having an opening 12*d* (FIG. 5) for receiving padlock bight 25*a*. Opening 23*c* of keeper flange 23*b* is aligned with opening 40*a* of flanged inner plate 40 (FIG. 5) of shield 30, and further in alignment with opening 12*d* (FIG. 5) in the distal end portion 12*c* of handle 12. With this alignment padlock bight 25*a* can be inserted through these openings to lock together keeper assembly 20, shield 30 and handle 12. Thus, with guide portion 38*a* of shield 30 inserted behind handle 12 as illustrated, there is provided anti-theft shielding apparatus that protects the latch handle and padlock on the large rear doors of cargo trucks and truck trailers.

Figure 5:
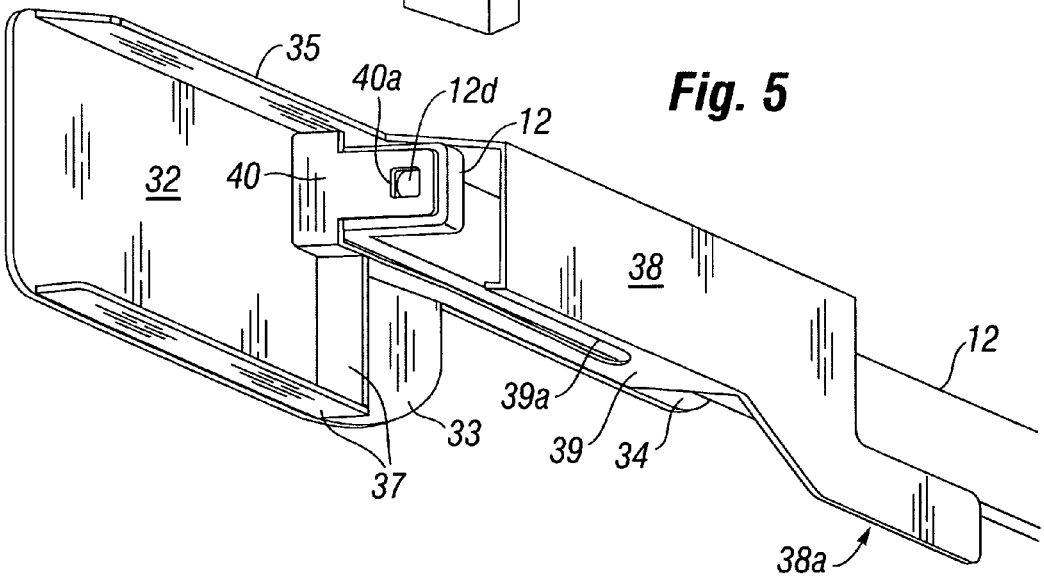
FIG. 5 is a rear perspective view of the anti-theft latch shield of FIG. 3.

FIG. 5 is a rear perspective view of shield 30 wherein it is seen that plate 32 includes an L-shaped bottom plate portion 37 extending rearward therefrom. Plate portion 37 and top plate portion 35*a* extend over plate 32 to provide anti-bending strength to plate 32. Rear plate 38 extends downwardly from the rear edge of top plate 35 and includes guide 38*a*. Bottom plate 39, having padlock bight slot 39*a*, extends inwardly from rear plate 38 to connect with plate 34 whereby plates 34, 35, 38 and 39 form a protective enclosure, or sheath, for accepting handle 12. Additional anti-bending strength is provided to the shield 30 by bottom plate 39. This is an important feature of the invention since without sufficient bending resistance any ant-theft device is seriously compromised. Also seen extending from rear plate 38 is a single tine guide portion 38*a* which is positioned behind handle 12 and hook 15 when the shield 30 of the invention is attached, to thereby maintain the shield 30 in the required position. The additional bending strength provides by the aforementioned enclosure is important to prevent bending of the guide portion 38*a* which would prevent required placement of the tine of guide portion 38*a* behind handle 12. Inner plate 40 extends inwardly from plate 32 and has opening 40*a* for receiving padlock bight 25*a*. The distal end portion 12*c* of handle 12 has opening 12*d* also for receiving padlock bight 25*a*. When assembled as shown, plates 34, 35, 38 and 39 provide a protective enclosure for sliding over latch handle 12, and plates 32, 33 and 35*a*, as will be described, provide a protective pocket for padlock 25.

Figures 6, 7:
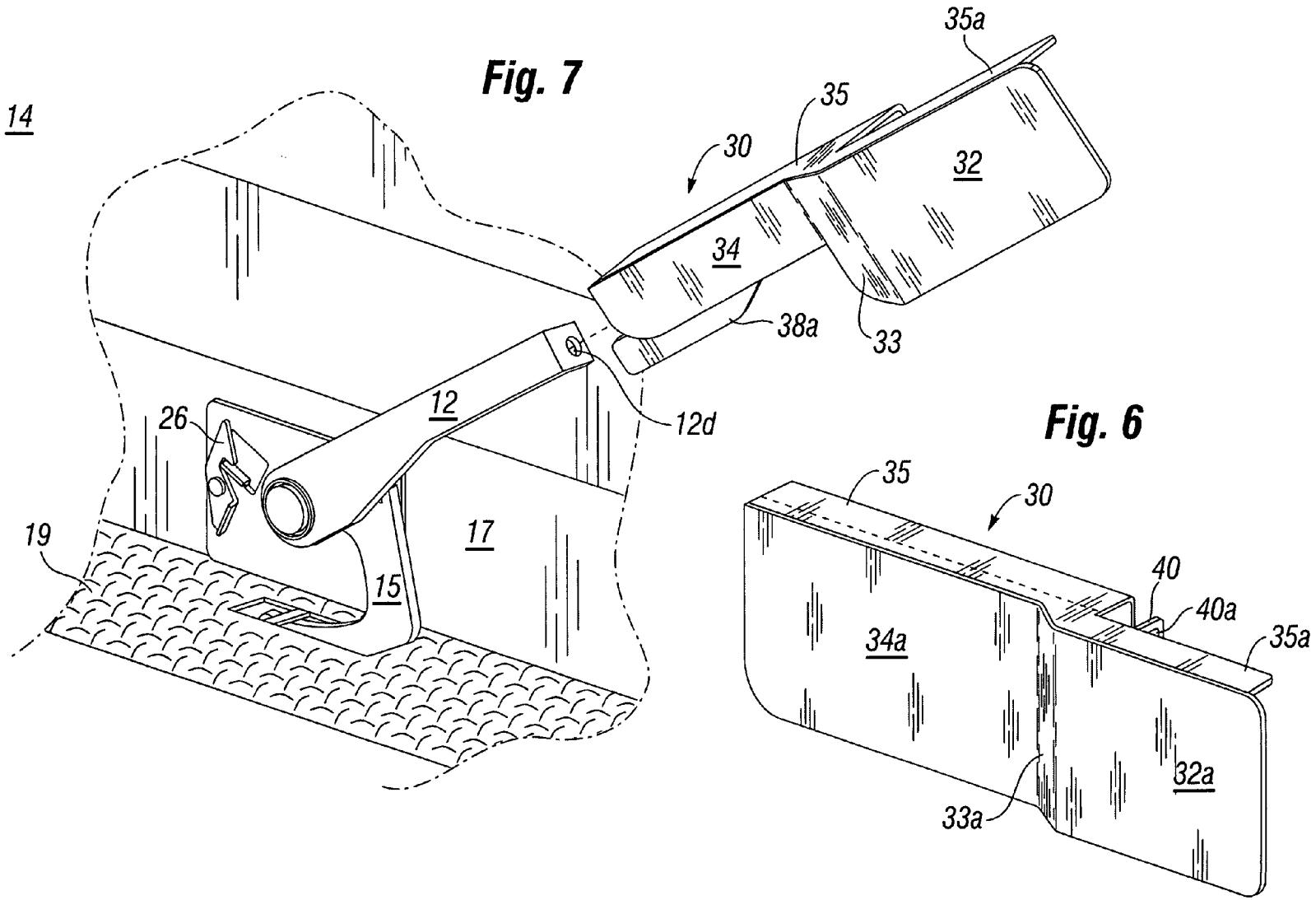
FIG. 6 is a modified version of the anti-theft latch shield of FIG. 4.
FIG. 7 is a perspective view indicating the method of attachment of the anti-theft latch shield of the invention to the latch handle of the locking mechanism of FIG. 1.

FIG. 6 is a modified version of the anti-theft latch shield of FIG. 4 wherein the dimensions of plates 32-24 are shown to be increased, as indicated by plates 32*a*, 33*a* and 34*a*, to provide additional cover for the cargo door locking mechanism 10. It is to be understood that although only the heights of the plates are increased, additional dimensions could be changed within the spirit and scope of the invention.

FIG. 7 is a perspective view indicating the method of attachment of the anti-theft shield 30 of the invention to the latch handle 12 of the locking mechanism 10. When the cargo door 17 is closed handle 12 is rotated clockwise about pivot pin 14 to the position as indicated in FIG. 3A. Shield 30 is then positioned as shown and slid down to encompass handle 12 with guide plate 38*a* sliding behind handle 12 and hook 15. The combination of the shield 30 with enclosed latch handle 12 is then rotated to the locking position as shown in FIG. 3B wherein the combination is mated to keeper 20 as illustrated in FIG. 4A. After assembly of handle 12 and shield 30 as described, padlock 25 is inserted into the assembled combination by placing the padlock bight 25*a* into the bight slot 39*a* plate 39 and sliding it along to transit opening 12*d* of distal end 12*c*, keeper openings 24*b* and 23*c*, and opening 40*a* of inner plate 40. The padlock 25 is then closed to complete the locking procedure.

Figure 8:
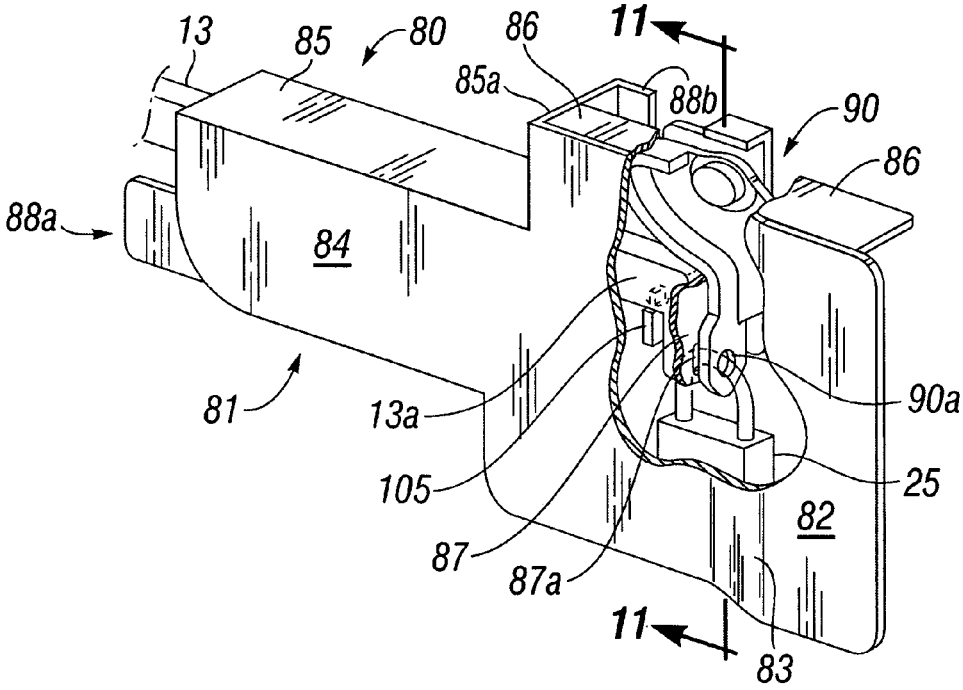
FIG. 8 is a perspective view illustrating final attachment of a second embodiment anti-theft latch cover to an alternate locking mechanism in accordance with the invention, and includes a fragmentary view of a portion of the keeper assembly of the alternate anti-theft shield.
Figure 8A:
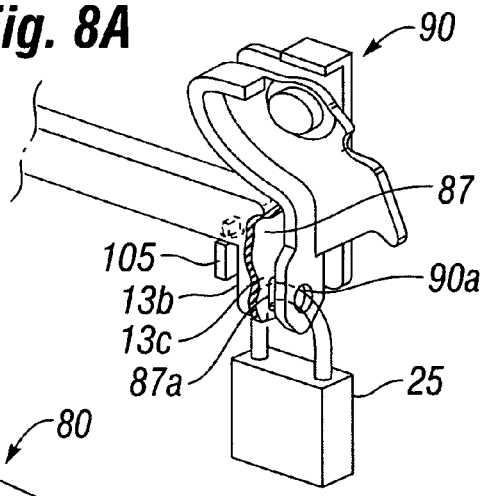
FIG. 8A is an enlarged view of the fragmentary view of FIG. 8.

FIG. 8 is a perspective views illustrating final attachment of a second embodiment anti-theft latch shield, generally designated 80, to an alternate locking mechanism in accordance with the invention, and includes a fragmentary view, shown enlarged in FIG. 8A, of a portion of the keeper assembly, generally designated 90, of the alternate anti-theft shield. Shield 80 is shown to include a longitudinally extending front plate generally designated 81, front plate 81 including plate portions 82, 83 and 84, planar plate portion 82 recessed inwardly in sloping manner by plate portion 83 to meet planar plate portion 84. A first portion of plate 84, topped by cover 85, extends laterally to the left to protect handle 13, and a second enlarged portion, topped by cover 86, extends to the right to protect the distal end 13*a* of handle 13, keeper 90, and padlock 25.

The distal end 13*a* of handle 13 includes a downwardly extending "L" shaped portion 13*b* which includes opening 13*c* for receiving the bight of padlock 25. Top cover plate 86 covers the enlarged portion of plate 84 and plates 82 and 83. Plate 86 is connected to plate 85 by vertical plate 85*a*, plate 86 raised from and substantially parallel to plate 85. Front plate 82 extends laterally from plate 83 to provide additional protection for keeper 90 and padlock 25. Rear plate portion 88*a* and guide 88*b* are indicated and further discussed below.

The fragmentary view of FIG. 8, which is shown enlarged in FIG. 8A, illustrates the alternate keeper 90 and structure for locking handle 13 to keeper 09. Although of different design, keeper 90 operates in substantially the same manner as keeper 21 of the first embodiment and will be discussed only as necessary to explain the configuration and installment of the anti-theft shield 80. For receiving the bight of padlock 25, keeper 90 has opening 90*a* which is aligned with opening 87*a* of inner plate 87 that extends internally from shield plate 84, and opening 13*c* in "L" shaped portion 13*b* in the distal end 13*a* of handle 13. Also shown is stop 105 for properly aligning opening 13*c*. After positioning shield 80 and closure of the latch handle 13, padlock 25 is inserted into the assembled combination by placing the padlock bight 25*a* into the padlock bight slot 89*a* and slid along to transit aligned apertures 13*c* of distal end 13*b*, 87*a* of plate 87 and 90*a* of keeper 90. The padlock 25 is then closed to complete the locking procedure.

Figure 9:
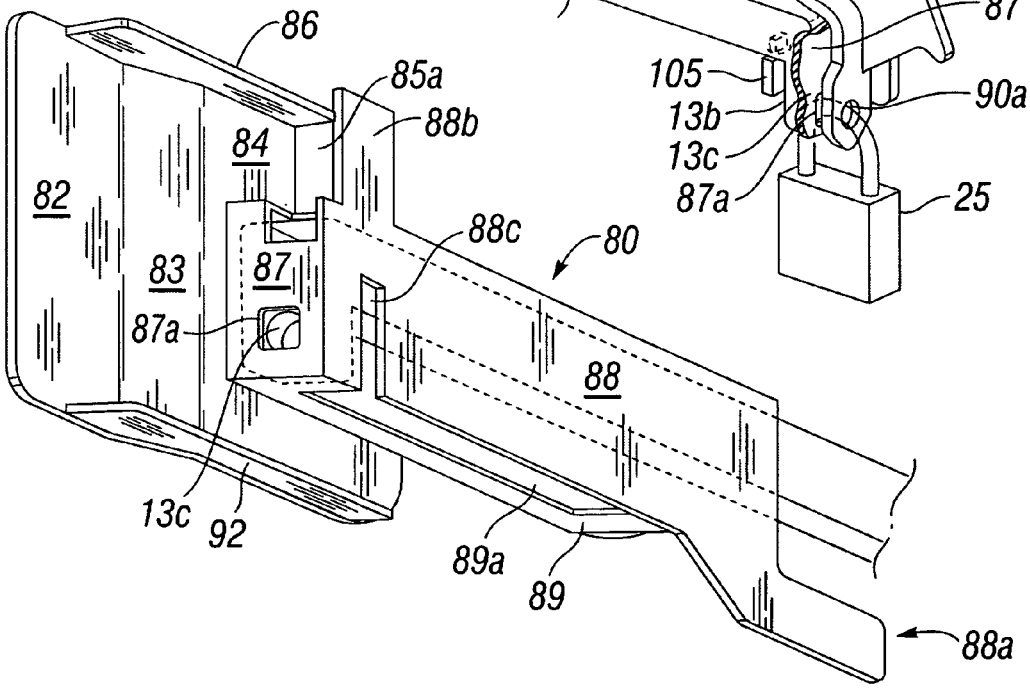
FIG. 9 is a rear perspective view of the alternate anti-theft latch shield of FIG. 8.

FIG. 9 is a perspective view of the rear of the alternate shield of FIG. 8 showing top shield plate 86, vertical plate 85*a*, and rear plate 88 which includes guide portion 88*a* for positioning behind handle 13 and hook 15, plate portion 88*b* extending upwardly from plate 88 and attached to plate 85*a*. Plate 88 has a vertical slot 88*c* and bottom plate 89 has a longitudinally extending slot 88*c*. Also shown is bottom plate 92 connected to and extending inwardly of plates 82, 83 and 84. Vertical plate 85*a* is shown to extend rearwardly to connect to rear plate portion 88*b*. Rear plate 88 is connected to plate 84 by plate 87, plate 87 including aperture 87*a* for accepting the bight of lock 25.

Upon assembly as shown, plates 84, 85, 88, and 89 provide a protective sheath for sliding over latch handle 13, and plate portions 82, 83, 84, 86 and 92 provide a protective pocket for keeper 90 and padlock 25. It is thus seen that although alternate shield 80 is designed to accommodate a different latching assembly, the basic shielding and locking procedure in essentially the same, that is, the latch handle distal end, sheath locking plate, and keeper assembly apertures of both embodiments basically operate in the same manner.

Figure 10:
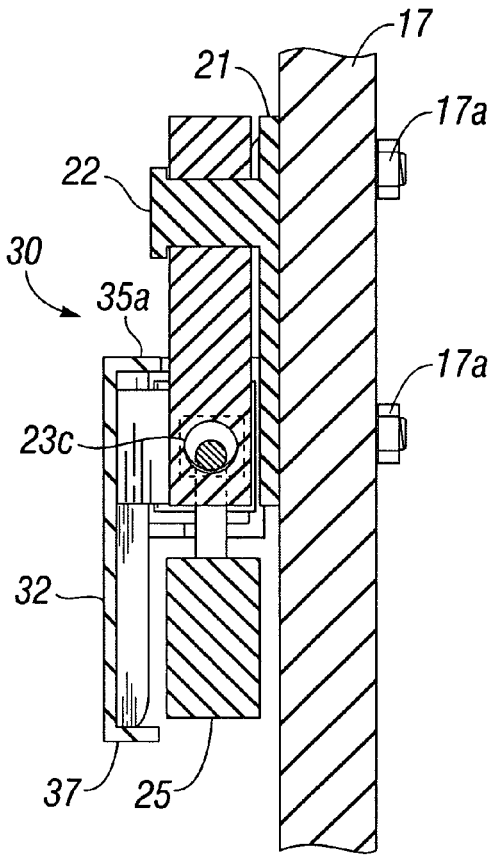
FIG. 10 is a cross sectional view taken along lines 10-10 as shown in FIG. 4.
Figure 11:
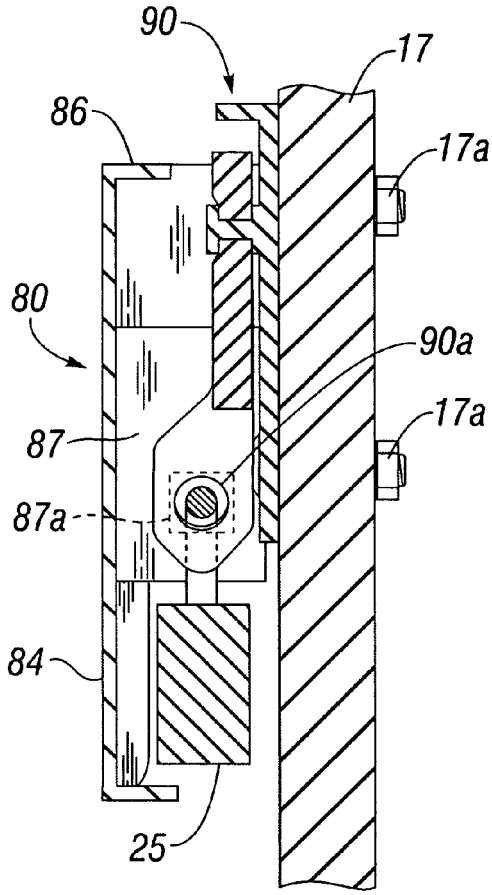
FIG. 11 is a cross sectional view taken along lines 11-11 as shown in FIG. 8.

FIG. 10 is a cross-sectional view taken along the lines 10-10 of FIG. 4 and FIG. 11 is a cross-sectional view taken along the lines 11-11 of FIG. 8. Keepers 21 and 90 are shown as attached to cargo door 17 by bolts 17*a*.

Whereas the invention is illustrated and described with reference to embodiments thereof, it should be understood that various changes may be made in adapting the invention to different embodiments without departing from the broader inventive concepts disclosed herein. For instance, although the shield of the invention is shown constructed in one piece it is to be understood that it can as well be constructed of multiple pieces. It is important, however, that the shield be made of metal or other material that cannot be easily cut with bolt cutters or breached by other means for accessing the locking mechanism of the invention.

What is claimed is:

1. Anti-theft apparatus for inhibiting access to a truck cargo door, comprising:

a latch mechanism for releasably locking said cargo door to the body of said truck, said latch mechanism including:

an elongated handle attached at a first end to said cargo door at a pivot point and a hook member attached to said handle, said handle pivotable about said pivot point to interlock said hook member with the body of said truck, a latch member displaced on said cargo door from said pivot point and fixedly connected to said cargo door for receiving and securing the second end of said handle;

a padlock engageable with said second end of said handle and with said latch member for locking said handle to said cargo door;

an elongated generally rectangular sheath member for sliding over and enclosing said handle from said second end, and a padlock cover member integrated with said sheath member for protecting said handle, said latch member and said lock, said sheath member having a single tine member extending therefrom for insertion behind said handle and below said pivot point;

said cover member is offset forwardly from said sheath member and includes rearwardly extending top, bottom and side plates to provide anti-tamper strength; and said cover member including a locking bracket having an opening for accepting the bight of said padlock for interlocking said handle, said latch member and said sheath member.

2. The apparatus of claim 1 wherein said sheath member includes a front, top, back and bottom side, said back side including said tine member extending therefrom, and said bottom side including an opening for accepting the bight of said padlock for interlocking said handle, said latch member and said sheath member.

3. The apparatus of claim 1 wherein said opening in said locking bracket lines up with openings in said handle and said latch member for interlocking said handle, said latch member and said sheath member.

4. The apparatus of claim 1 wherein said tine member depends from said back side and extends from said sheath member for positioning behind said handle and below said pivot point thereby stabilizing vertical movement of said sheath member at said pivot point.

5. Anti-theft apparatus for inhibiting access to a truck cargo door latching mechanism that includes a handle pivotal about a pivot point, handle latching mechanism, and a lock engageable with said latching mechanism, said apparatus comprising:

an elongated generally rectangular sheath member slidable over said handle to said pivot point and having an extending tine member for insertion behind said handle and below said pivot point;

said handle pivotal about said pivot point for engagement with said latching mechanism in a latching position;

said lock positioned through said apparatus to lock said handle to said latching mechanism;

a cover member integrated with said sheath member and positioned to provide a protected space for said latching mechanism and said lock;

said cover member is offset forwardly from said sheath member and includes rearwardly extending top, bottom and side plates to provide anti-tamper strength; and said cover member includes a locking bracket with a opening through which said lock is engaged.

6. The apparatus of claim 5 wherein said sheath member includes a front, top, back and bottom side, said tine member extending from said back side and said bottom side including an opening for accepting the bight of said padlock for interlocking said handle, said latch mechanism and said sheath member.

7. The apparatus of claim 6 wherein said tine member is positioned behind said handle and below said pivot point to prevent vertical movement of said sheath member at said pivot point.

8. A method for inhibiting access to a truck cargo door latching mechanism which has a latch handle pivotal about a pivot point attached to said door and secured by a padlock comprising the steps of:

providing a security device which has an elongated generally rectangular sheath member integrated with a padlock cover member, said sheath member including a tine member extending therefrom and said cover member including a locking bracket;

positioning the free end of said handle within said sheath member so that said tine member slides behind said handle and below said pivot point;

pivoting the sheathed handle to place said locking bracket into a locking position with said padlock; and inserting the padlock through the locking bracket to lock said cover member to said latching mechanism; and wherein said sheath member includes a front, top, back and bottom side, said tine member extending from said back side, and said bottom side including an opening for accepting the bight of said padlock for interlocking said handle, said latching mechanism and said sheath member.

9. The method of claim 8 wherein said cover member is offset forwardly from said sheath member and includes rearwardly extending top, bottom and side plates to provide anti-tamper strength.

10. The method of claim 9 wherein said tine member is positioned behind said handle and below said pivot point to prevent vertical movement of said sheath member at said pivot point.

* * * * *